US005493753A

United States Patent [19]

Rostamo

[11] Patent Number: 5,493,753

[45] Date of Patent: Feb. 27, 1996

[54] VACUUM CLEANING SYSTEM WITH WATER EXTRACTION LID

[75] Inventor: Gary Rostamo, Benbrook, Tex.

[73] Assignee: Steamatic, Inc., Fort Worth, Tex.

[21] Appl. No.: 376,856

[22] Filed: Jan. 23, 1995

[51] Int. Cl.[6] ..... A47L 11/30

[52] U.S. Cl. ..... 15/321; 15/322; 15/353; 55/413; 55/DIG. 3

[58] Field of Search ..... 15/321, 322, 353; 155/413, DIG. 3

[56] References Cited

U.S. PATENT DOCUMENTS

| | | | |
|---|---|---|---|
| 4,151,627 | 5/1979 | Wisdom | 15/321 |
| 4,167,798 | 9/1979 | Klugl et al. | 15/321 |
| 4,974,618 | 12/1990 | Nysted | 15/321 |

*Primary Examiner*—Frankie L. Stinson

*Assistant Examiner*—Terrence R. Till

*Attorney, Agent, or Firm*—Arthur F. Zobal

[57] ABSTRACT

The cleaning system has a head to which water is applied for cleaning carpets, etc. The head has a water nozzle for injecting hot water on the carpet, etc. and a vacuum inlet with vacuum hose coupled to a vacuum container. A lid having an outlet is provided for covering the top of the container. A hose is connected to the lid outlet and to a vacuum blower. A lid conduit forming the lid outlet extends through the lid with inlet openings formed through the lower portion of the outlet conduit. A chamber extends from the lower side of the lid surrounding the lower portion of the lid conduit with a bottom wall located below the lower portion of the lid conduit. A plate is connected to the bottom of the lid conduit and extends outward forming a dead space between the plate and the bottom wall of the chamber. An opening is formed through the side wall of the chamber for passage of air from the container into the chamber and to the vacuum device. The dead space is employed to keep water from passing to the vacuum blower.

3 Claims, 3 Drawing Sheets

VACUUM CLEANING SYSTEM WITH WATER EXTRACTION LID

BACKGROUND OF THE INVENTION

1. Field of the Invention

The invention relates to a vacuum cleaning system with an apparatus for preventing water from being drawn into the vacuum pump.

2. Description of the Prior Art

U.S. Pat. Nos. 3,812,552; 5,095,578 and 5,099,543 disclose vacuum cleaning systems employing a cleaning head with nozzles with means for injecting hot water through the nozzles onto carpets, etc. for cleaning purposes. A vacuum conduit is coupled from the head to a vacuum tank or container which in turn is coupled to a vacuum blower for removing water and dirt, etc. from the carpet to be cleaned into the container. These are large units employing a large vacuum container which minimizes the problem of water entering the vacuum blower from the vacuum container.

In smaller units used for spot removal or small area cleaning and employing a small vacuum container the problem of vacuumed water enter into the blower motor from the vacuum container, however, is increased.

SUMMARY OF THE INVENTION

It is an object of the invention to provide a lid mechanism for a vacuum container which minimizes the problem of vacuumed water from entering the vacuum motor from the vacuum container.

The container has an upper end with an upper inlet. A lid having an outlet is provided for covering the upper end of the container. A cleaning head is provided having an outlet to remove water and other materials from the object to be cleaned. A conduit is coupled from the head outlet to the upper inlet of the container. A vacuum device has an inlet with a conduit coupled from the lid outlet to the inlet of the vacuum device for drawing air, water and other materials from the head outlet into the container and for drawing air from the container by way of the lid outlet conduit.

The lid comprises an upper wall having a lower side with an opening extending therethrough. A lid conduit having an upper end defining the lid outlet is provided with a lower portion of the lid conduit extending through the opening to a lower end below the lower side of the upper wall. A side wall is coupled to the lower side of the upper wall and extends around the lid conduit to a lower end located below the lower end of the lid conduit. A bottom wall is coupled to the lower end of the side wall such that the upper wall, the side wall and the bottom wall form a chamber.

An inlet is formed through the side wall for the flow of air from the container into the chamber. An intermediate wall is coupled to the lower end of the lid conduit and extends outward at a position above the bottom wall forming a protected space. An inlet is formed through the wall of the lid conduit below the upper wall and above the intermediate wall for the flow of air from air chamber into the lid conduit to the inlet of the vacuum device. The lower side of the upper wall is adapted to engage the upper end of the container with the side wall and the bottom wall including the lower portion of the lid conduit and the intermediate wall located in the container such that water entering the container from the conduit of the head due to the reduced pressure in the container is prevented from entering the inlet of said lid conduit due in part to the protected space which is out of the main flow path of air from the container into the chamber.

DESCRIPTION OF THE PREFERRED EMBODIMENT

Figure 1:
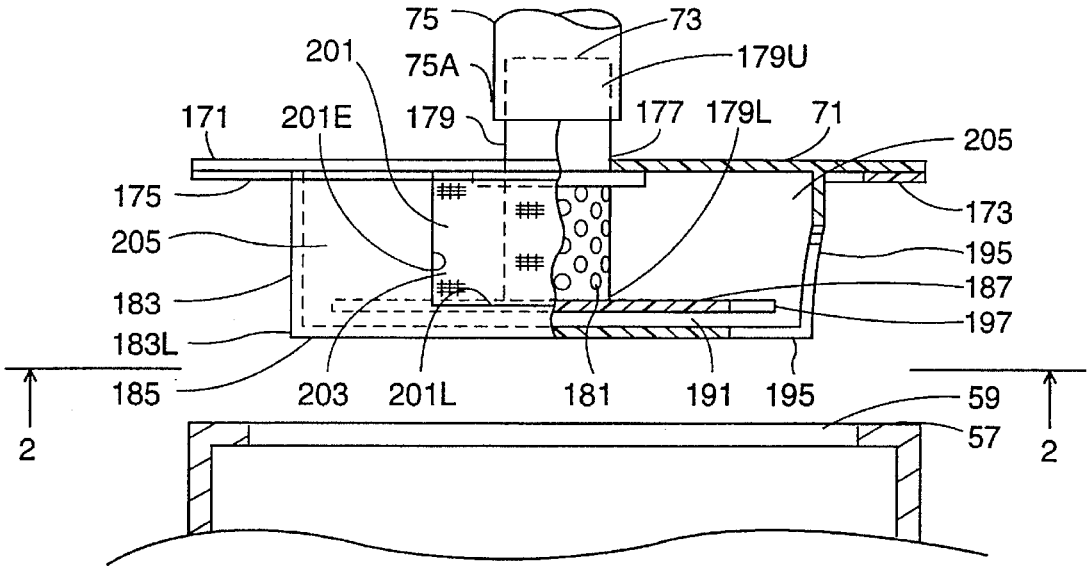
FIG. 1 is a cross-sectional view of the lid mechanism of the invention.
Figure 2:
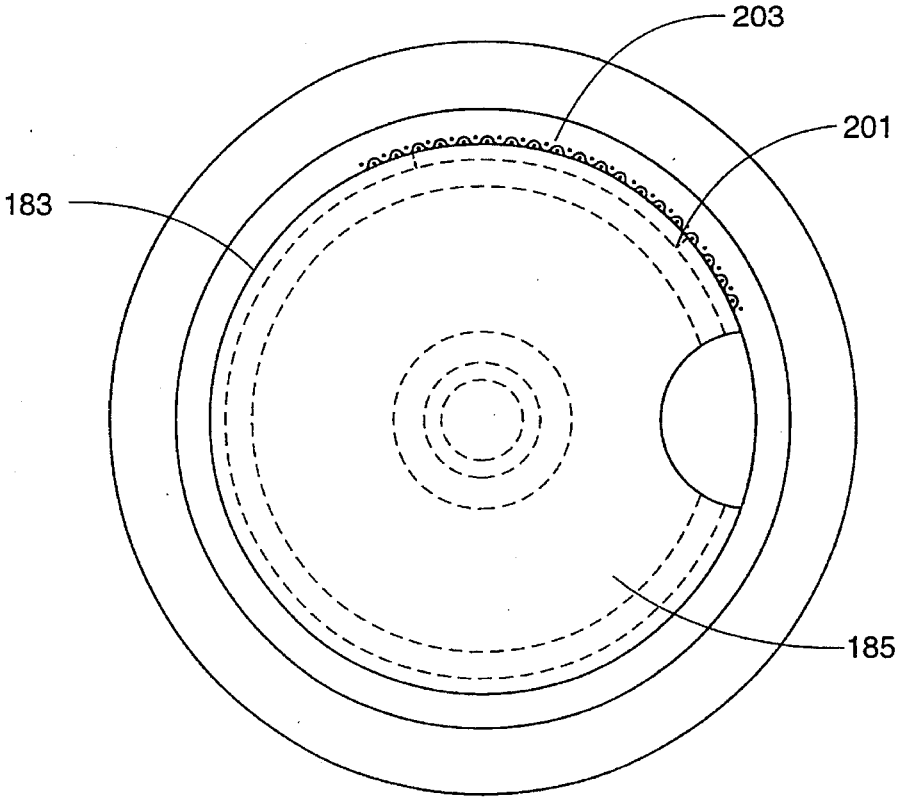
FIG. 2 is a view of FIG. 1 as seen from lines 2—2 thereof.
Figure 3:
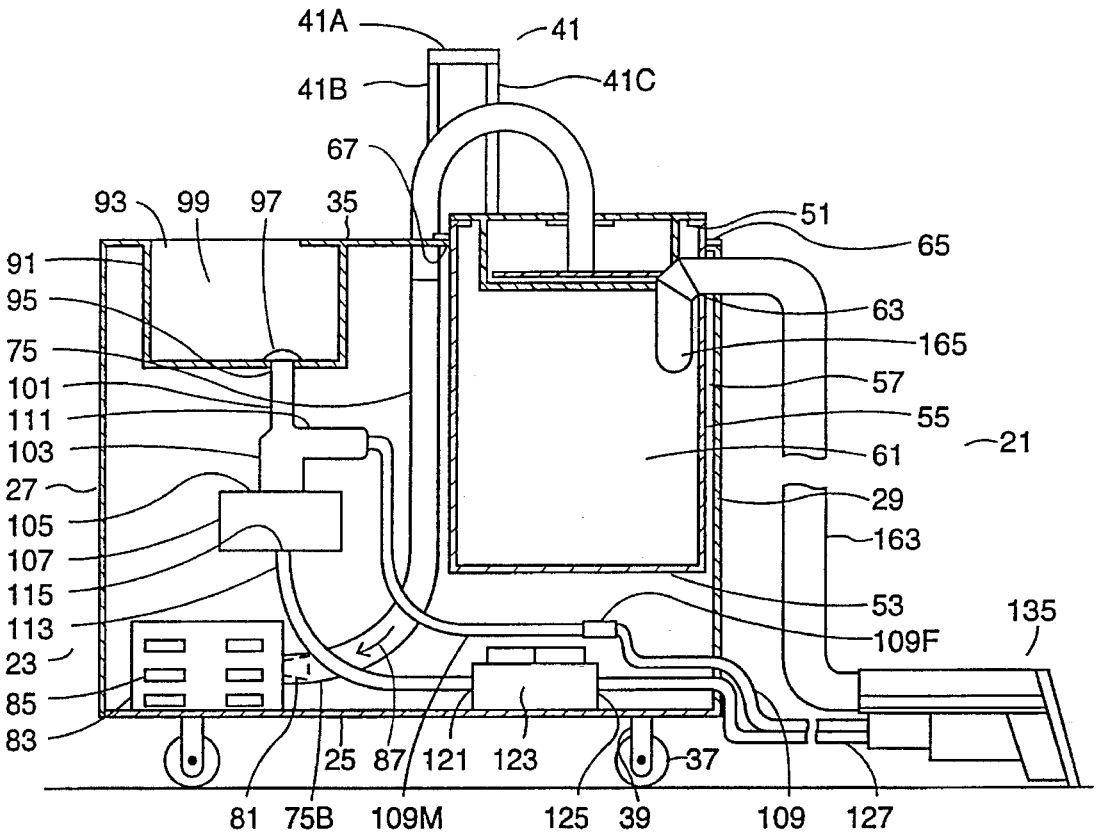
FIG. 3 is a cross-sectional view of the complete system of the invention.

Referring now to the drawings, the cleaning system of the invention is identified by reference numeral 21. It comprises a frame 23 having a bottom wall 25 four side walls 27, 29, 31, and 33 and a top wall 35. Wheels 37 are provided to allow the frame 23 to be moved on a floor. Four wheels are provided however only two are shown. The wheel support 39 can pivot to allow the frame to be moved in different directions. A pull out handle 41 is provided to facilitate moving the system. The handle 41 comprises a cross-bar 41A attached to two arms 41B and 41C which may be moved upward out of an aperture 43 for use as shown in FIG. 3 and moved inward to a storage position when not in use such that the bar 41A is located close to the level of the top wall 35.

Supported by the frame 23 is a cylindrical shaped vacuum tank or container 51 having a round bottom wall 53, a cylindrical shaped side wall 55 with an annular inwardly extending ledge 57 forming a round upper opening 59 leading to the interior 61 of the container. Formed through the side wall 55 at its upper end is an inlet opening 63. The container wall 55 has an outer flange 65. The top wall 35 has a round opening 67 to allow the container 51 to be removably located in the opening 67 and supported by the flange 65 engaging the top wall 35.

A round lid 71 is provided for engaging the ledge 57 for covering the container opening 59 as will described subsequently. The lid 71 has an outlet 73 to which one end 75A of a flexible conduit 75 is coupled. The other end 75B of the conduit 75 is coupled to the inlet 81 of a vacuum blower 83 having outlet openings 85. The vacuum blower 83 has a fan blade driven by an electric motor to move an air in the direction of arrow 87 to draw a vacuum (reduce the pressure) in the container 51. The blower 83 is supported on the bottom wall 25.

Connected to the inside of the top wall 35 is a water container 91 having an upper opening 93 formed through the wall 35 and a lower outlet 95 having a filter 97. Water and cleaning fluid is located in the interior 99 of the container 91. Coupled to the outlet 95 is a conduit 101 having a lower end 103 coupled to the inlet 105 of an electrically actuated water pump 107. A water return flexible hose 109 has an enlarged outlet fitting 111 coupled to the conduit 101.

Figure 4:
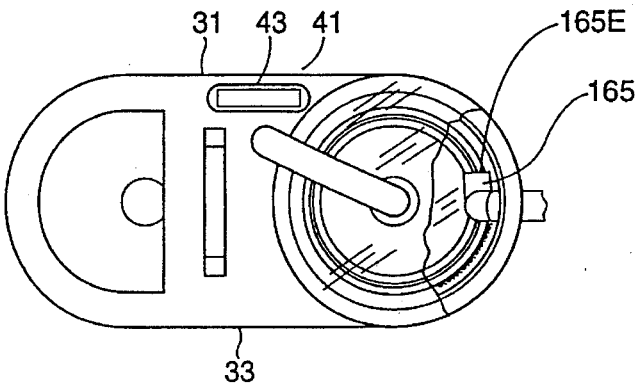
FIG. 4 is a top view of the apparatus of FIG. 3.
Figure 7:
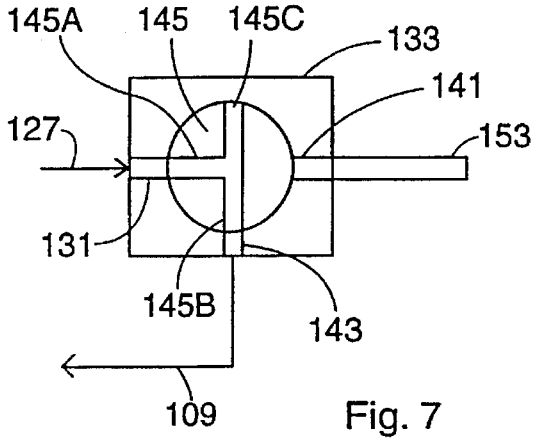
FIG. 7 illustrates the valve and nozzles of the cleaning head of the system of FIG. 3.
Figure 5:
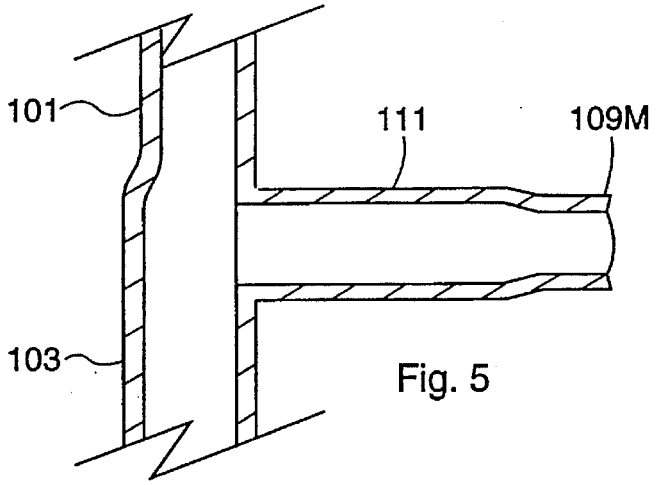
FIG. 5 is an enlarged cross-sectional view of the water return connection between the water container and the pump.
Figure 6:
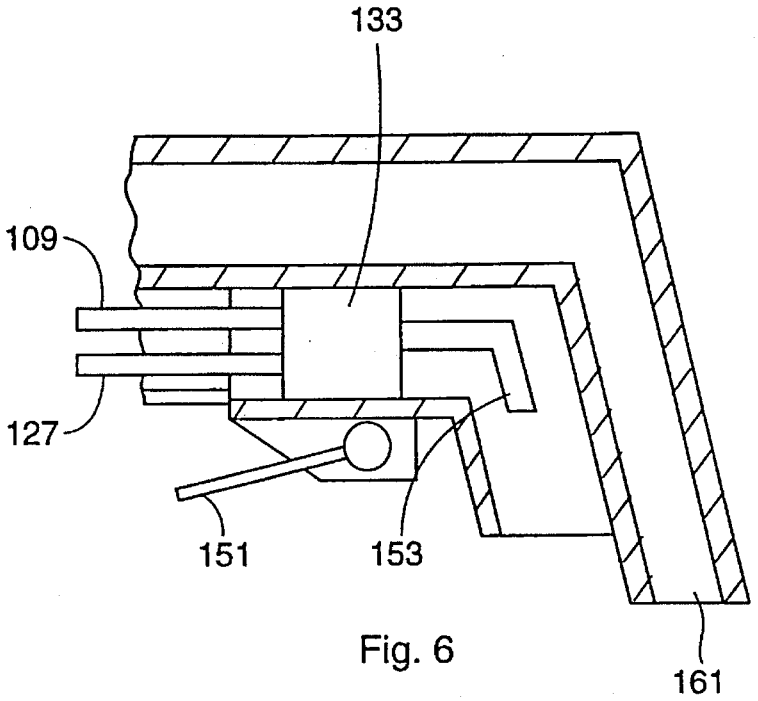
FIG. 6 is an enlarged cross-section of the cleaning head of the system of FIG. 3.

A conduit 113 has one end coupled to the outlet 115 of the pump 107 and an opposite end coupled to an inlet of 121 of an electrically operated water heater 123. The outlet 125 of the water heater 123 is coupled to a flexible hose or conduit 127 which is coupled to the inlet 131 of a valve 133 supported in a head 135. The valve 133 has two outlets 141 and 143 and a movable member 145 which normally is in the position shown in FIG. 7 to couple passageways 145A and 145B to outlet 143 which is coupled to hose or conduit 109. The member 145 is rotatable clockwise by a handle 151 to couple passageways 145B and 145C from inlet 131 to outlet 141 which is coupled to nozzles 153 supported by head 135 to direct the hot water onto the carpet or object to be cleaned. The head 135 has a vacuum or low pressure inlet 161 which is coupled to one end of a flexible hose or conduit 163 which has its other end coupled to the container inlet 63. The hose in the container has as outlet 165 which is directed counter-clockwise as shown in FIGS. 3 and 4.

In operation, the hot water heater 123 and pump 107 are operated to circulate hot water from hose 127 through valve 133 to hose 109 and back to the pump. When cleaning operations are to take place, the head 135 is placed against the carpet or other object to be cleaned and the handle 151 is operated to cause hot water to be injected through nozzles 153 onto the carpet. The head is moved backward and the vacuum blower 83 is operated to draw air in the direction of the arrow 87 which causes air, material such as dirt and water to be dram into inlet 161, through the hose 163 into the container 51 and the air to be drawn by way of hose 75 into the blower inlet 81 and out of the blower outlets 85.

As the air, dirt, etc., and water are drawn into the container 51, the water swirls counter-clockwise moving upward and then downward. The lid comprises diverter structure which allows enough time for the water to separate from the air and prevents the water from entering the vacuum hose 75 allowing only the air to be drawn into the vacuum hose 75 and vacuum motor thereby minimizing corrosion or other damage to the vacuum blower.

The lid 71 comprises a round flat plate 171 having an annular pad 173 at its edge on its lower side 175 to form a seal when it engages the ledge 57. The plate 171 has a central aperture 177 extending therethrough. A lid conduit 179 extends through the aperture 177 to a lower end 179L on the lower side 175 of the plate 171. Inlet openings 181 are formed through the wall of the conduit 179 below the lower side of the plate 171. The upper end 179U of the conduit 179 defines the lid outlet 73. A cylindrical wall 183 is coupled to the lower side 175 of the plate surrounding the conduit 179 and extends to a lower end 183L. A round lower wall 185 is connected to the lower end 183L of the wall below the conduit end 179L. A round intermediate wall 187 is connected to the lower end 179L of the conduit and extends radially outward toward the wall 183 above the wall 185 forming a protected or dead space 191 between walls 185 and 187.

Walls 183, and 185 and wall 187 have cut out portions forming slots 195 and 197 for receiving the outlet conduit 165 of the vacuum hose 163 when the lid is located on the ledge 57.

An opening 201 is formed through the cylindrical wall 183 on a side opposite the direction that the hose outlet 165 is facing. A screen 203 is secured over the opening 201. The hose outlet 165 faces in a direction about level with a plane parallel to the bottom wall 53. The forward edge 201E of the opening is about 270 degrees from the end 165E of the hose outlet 165. When the water is injected into the container, its velocity causes the water to climb the inside wall of the container reaching its maximum height about 100 degrees from the outlet 165. As the velocity slows, the water falls such that the water is below the lower edge 201L of the opening 201 when it reaches the side of the opening 201. Thus as the water swirls from the outlet 165 it will move up and then down below the opening 201 as it approaches the side of the opening 201 minimizing the splashing of water through the opening 201.

The air flowing into the container 51 through the outlet 165, flows through the opening 201 into the chamber 205 formed by walls 171, 183, and 185, through the inlet openings 181 of the conduit 179, through the outlet 73 into the hose 75 and through the vacuum blower 83. The dead space 191 is located below the lower end 201L of the opening 201 and below the wall 187 and is out of the main flow path of the air flowing through the opening 201. As the container 51 gets fuller with water the chances of water entering the opening 201 increases. In this respect water beads tend to move up the wall 183 and on through the screen 201 due to the vacuum. Gravity causes some of the water beads to drop to the inside of the bottom wall 185, however, the dead space 191 prevents the water from moving upward past the wall 187 through the inlet openings 181.

In one embodiment, the container 51 has an inside diameter of 8 inches and a height of 9 inches. The inside diameter of wall 183 is 5 ¾ inches and its depth below wall 171 is 1 ⅝ inches. The outside diameter of conduit 179 is 1 ¼ inches. The intermediate wall 187 has a diameter of 5 inches and the height of the dead space 191 is ⅜ of an inch. The opening 201 has height of 1 inch and a length of 3 inches. The dead space 191 is located below the blower edge 201L of the opening. The inside diameter of each of the hoses 163 and 75 is about 1 ¼ inches. The blower motor 83 can move air at 83 CFM.

The hoses 113, 127 and 109 each have an inside diameter of about 3/16 of an inch.

The pump 107 is an impeller type pump which tends to lock up if air passes into the pump. In order to prevent air from the return hose 109 from entering the pump 107, the inside diameter of the hose 109 and its outlet fitting 111 increases in size. This slows down the velocity of the return water such that air has time to come out of the water and bleed upward into the water tank 91. This minimizes the chances of air from the return water passing into the pump 107.

The inside diameters of hoses 109 and 127 from the machine 23 to the head 135 are each ¼ of an inch. The return hose 109 inside the machine has a fitting 109F which is coupled to a hose 109M having an inside diameter of ⅜ of an inch. The hose 109M is coupled to fitting 111 having an inside diameter of ½ of an inch. Hose 101 has an inside diameter of ⅜ of an inch and hose 103 has an inside diameter of ½ of an inch.

It is to be understood that the dimensions and specifications listed above could vary depending on the size of apparatus of the invention.

I claim:

1. A cleaning apparatus, comprising:

a receiving container having an upper end with an upper inlet, a lid for covering said upper end of said receiving container, said lid having an outlet, a vacuum device having an inlet coupled to said outlet of said lid, a water container having an outlet, a pump having a pump outlet and a pump inlet with said pump inlet being coupled to said outlet of said water container, a water heater having a water heater outlet and a water heater inlet with said water heater inlet being coupled to said pump outlet, a cleaning head having a fluid nozzle and a passage with an inlet and an outlet, a hot water conduit coupled from said water heater outlet to said nozzle, a conduit coupled from said outlet of said passage of said head to said upper inlet of said receiving container and having a discharge end in said receiving container for directing air, water, and other materials into said receiving container, said lid comprising an upper wall having a lower side with an opening extending therethrough, a lid conduit having an upper end defining said lid outlet with a lower portion of said lid conduit extending through said opening to a lower end below the lower side of said upper wall, a side wall coupled to said lower side of said upper wall and extending around said lid conduit to a lower end located below said lower end of said lid conduit, a bottom wall coupled to said lower end of said side wall such that said upper wall, said side wall and said bottom wall form a chamber, an inlet formed through said side wall for the flow of air from said receiving container into said chamber, an intermediate wall coupled to the lower end of said lid conduit and extending outward therefrom at a position above said bottom wall forming a protected space, an inlet formed through the wall of said lid conduit below said upper wall and above said intermediate wall for the flow of air from said chamber into said lid conduit to said inlet of said vacuum device, said lower side of said upper wall being adapted to engage said upper end of said receiving container with said side wall and said bottom wall including said lower portion of said lid conduit and said intermediate wall located in said receiving container and with said inlet of said side wall located on a side of said container spaced from said discharge end such that water entering said receiving container from said conduit of said head is prevented from entering said inlet of said lid conduit due to the position of said inlet of said side wall relative to said discharge end and due to said protected space which is out of the main flow path of air from said receiving container into said chamber.

2. The cleaning apparatus of claim 1, comprising:

said head and having a valve with an inlet coupled to said hot water conduit, a first outlet coupled to said nozzle and a second outlet, said valve including means selectively operable to provide a flow path from said valve inlet to either of said valve outlets, a return conduit having an end coupled to said second outlet of said valve and an enlarged end coupled to said water container and said inlet of said pump for allowing return water from said valve to flow back to said pump, said enlarged end reducing the velocity of the return water flowing to said pump inlet to allow air in the return water to flow to said water container.

3. A cleaning apparatus, comprising:

a container having an upper end and an upper inlet, a lid for covering said upper end of said container, said lid having an outlet, a cleaning head having a passage with an inlet and an outlet for cleaning objects and to remove water and other materials from object to be cleaned, a conduit coupled from said outlet of said passage of said head to said upper inlet of said container, and having a discharge end in said container, a vacuum device having an inlet with a conduit coupled from said outlet of said lid to said inlet of said vacuum device for drawing air, water and other materials from said outlet of said passage of said cleaning head into said container and for drawing air from said container by way of said outlet of said lid, said lid comprising an upper wall having a lower side with an opening extending therethrough, a lid conduit having an upper end defining said lid outlet with a lower portion of said lid conduit extending through said opening to a lower end below the lower side of said upper wall, a side wall coupled to said lower side of said upper wall and extending around said lid conduit to a lower end located below said lower end of said lid conduit, a bottom wall coupled to said lower end of said side wall such that said upper wall, said side wall and said bottom wall form a chamber, an inlet formed through said side wall for the flow of air from said container into said chamber, an intermediate wall coupled to the lower end of said lid conduit and extending outward therefrom at a position above said bottom wall forming a protected space, an inlet formed through the wall of said lid conduit below said upper wall and above said intermediate wall for the flow of air from said chamber into said lid conduit to said inlet of said vacuum device, said lower side of said upper wall being adapted to engage said upper end of said container with said side wall and said bottom wall including said lower portion of said lid conduit and said intermediate wall located in said container and with said inlet of said side wall located on a side of said container spaced from said discharge end such that water entering said container from said conduit of said head is prevented from entering said inlet of said lid conduit due to the position of said inlet of said side wall relative to said discharge end and due to said protected space which is out of the main flow path of air from said container into said chamber.

* * * * *